United States Patent [19]

Kalert et al.

[11] 4,170,615

[45] Oct. 9, 1979

[54] CARBURETOR WITH SECOND CHOKE BREAK

[75] Inventors: Ralph E. Kalert, Granite City, Ill.; John C. Green, St. Louis, Mo.

[73] Assignee: ACF Industries, Inc., New York, N.Y.

[21] Appl. No.: 864,700

[22] Filed: Dec. 27, 1977

[51] Int. Cl.[2] ..... F02M 1/16

[52] U.S. Cl. ..... 261/23 A; 261/39 B; 261/50 R; 261/39 D; 261/48; 261/DIG. 58

[58] Field of Search ..... 261/23 A, 39 B, 39 D, 261/50 R, 50 A, DIG. 56, DIG. 58, 48

[56] References Cited

U.S. PATENT DOCUMENTS

| | | | |
|---|---|---|---|
| 1,195,113 | 8/1916 | Smith | 261/48 |
| 1,590,059 | 6/1926 | Reents et al. | 261/48 |
| 1,946,284 | 2/1934 | Huber | 261/48 |
| 2,225,261 | 12/1940 | Jorgensen | 261/39 D |
| 2,595,720 | 5/1952 | Snyder | 261/DIG. 39 |
| 3,342,464 | 9/1967 | Mick | 261/50 A |
| 3,392,965 | 7/1968 | Harrison | 261/50 A |
| 3,680,846 | 8/1972 | Bickhaus et al. | 261/DIG. 56 |
| 3,802,671 | 4/1974 | Klutho | 261/DIG. 56 |
| 3,834,677 | 9/1974 | Hosho | 261/39 B |
| 3,885,545 | 5/1975 | Charron et al. | 261/39 D |

*Primary Examiner*—Tim R. Miles
*Attorney, Agent, or Firm*—J. Joseph Muller

[57] ABSTRACT

A carburetor has an induction passage, a fuel circuit and a choke valve positioned at the inlet of the induction passage. A metering rod extends transversely of the induction passage and has a variable diameter end portion projecting into an outlet of the fuel circuit. The metering rod is movable relative to the outlet in response to the choke valve opening and closing to control the quantity of fuel entering the induction passage. An opening force is exerted on the choke valve in response to the vacuum created in the engine, the exertion of this opening force being delayed until after an initial opening force has been exerted on the choke valve. The exertion of the second opening force moves the choke valve from a first position to a second and more fully open position. The variable diameter end portion of the metering rod is inserted into the fuel circuit outlet in response to this second movement of the choke valve whereby the quantity of fuel delivered to the induction passage is varied by an amount necessary to produce a resultant air-fuel mixture whose air-fuel ratio is both sufficient to keep the engine running and reduce emissions produced by the engine.

13 Claims, 8 Drawing Figures

CARBURETOR WITH SECOND CHOKE BREAK

BACKGROUND OF THE INVENTION

This invention relates to carburetors and more particularly to a mechanism for moving the carburetor's choke from a first choke break position to a second choke break position faster than would normally occur in response to engine warmup.

Normal carburetor choke operation is such that when an engine on which a carburetor is installed is started, the engine vacuum pulls the choke open to a choke break position and as the engine heats up, the choke is continually moved to a more fully open position. This serves to gradually lean out the air-fuel ratio of the combustible mixture produced by the carburetor. It has been found, however, that this gradual opening of the choke is not satisfactory under certain conditions as, for example, when the engine is accelerated to a cruise condition soon after starting. In such an event, the resultant air-fuel mixture produced by the carburetor is too rich. On the other hand, if a carburetor choke valve is moved too far during its initial opening movement, the air-fuel mixture produced is too lean and the engine will misfire or die. Either of the above circumstances has the disadvantage of greatly increasing the emissions produced by the engine and may result in the engine not meeting federal emission standards.

SUMMARY OF THE INVENTION

Among the several objects of the present invention may be noted the provision of a carburetor for an internal combustion engine; the provision of such a carburetor in which a choke valve of the carburetor opens faster than normally occurs as a result of engine warmup but not so fast as to cause the engine to misfire or die; the provision of such a carburetor which is a multi-barrel carburetor having a choke valve for each barrel, each choke valve opening faster than normally occurs as a result of engine warmup; and the provision of such a carburetor in which the faster than normal opening of the choke valve after engine starting helps reduce engine emissions.

Briefly, a carburetor of the present invention is for an internal combustion engine. The carburetor has at least one induction passage through which air is drawn into the engine, a fuel circuit through which fuel is delivered to the induction passage for mixing with air to form an air-fuel mixture combusted in the engine, a choke valve positioned at the inlet of the induction passage and movable between a closed and an open position, means responsive to the temperature of the engine for exerting a closing force on the choke valve to close it, the closing force lessening as engine temperature increases, and means responsive to the vacuum created in the engine when it is running for exerting an opening force on the choke valve which overcomes the closing force and moves the choke valve to an open position. A metering rod extends transversely of the induction passage and has a variable diameter end portion projecting into an outlet of the fuel circuit. The metering rod is movable relative to the fuel circuit outlet to control the quantity of fuel entering the induction passage. Linking means responsive to the movement of the choke valve moves the metering rod relative to the fuel circuit outlet as the choke valve opens and closes. The variable diameter end portion of the metering rod is withdrawn from the fuel circuit outlet as the choke valve closes and is inserted into the fuel circuit outlet as the choke valve opens. Second means responsive to the vacuum created in the engine exerts a second opening force on the choke valve. This second vacuum responsive means includes means for delaying the exertion of the second opening force on the choke valve until after the first opening force is exerted thereon. Exertion of the second opening force on the choke valve moves the valve from its first open position to a second and more fully open position. The variable diameter end portion of the metering rod is inserted further into the fuel circuit outlet by the linking means in response to the movement of the choke valve from its first to its second open position whereby the quantity of fuel delivered to the induction passage is varied by an amount of necessary to produce a resultant air-fuel mixture whose air-fuel ratio is both sufficient to keep the engine running and reduce the emissions produced by the engine. Other objects and features will be in part apparent and in part pointed out hereinafter.

DESCRIPTION OF THE PREFERRED EMBODIMENT

Figure 1:
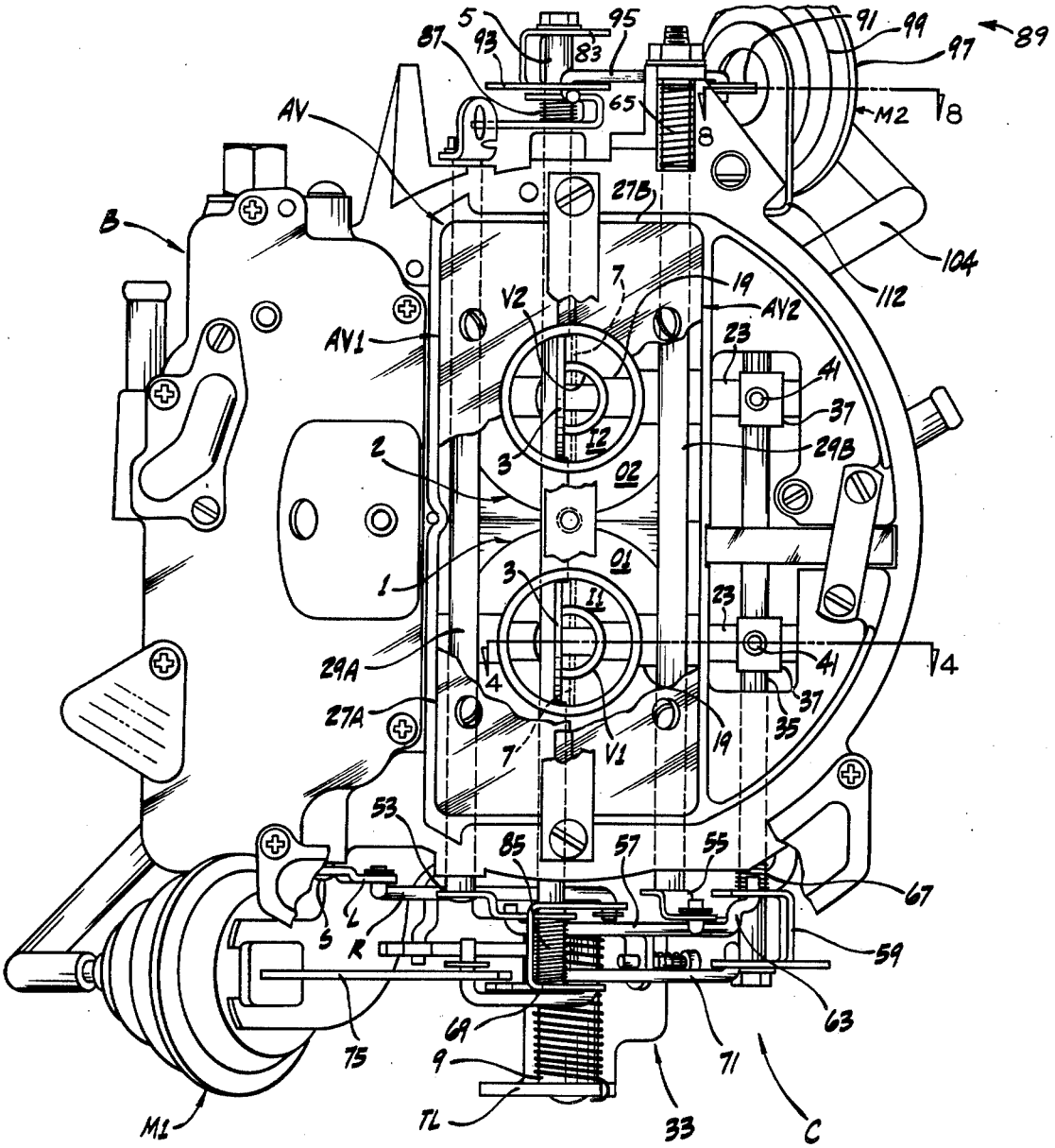
FIG. 1 is a top plan view of a carburetor of the present invention.

Referring now to the drawings, a staged carburetor for an internal combustion engine (not shown) is indicated generally C and has a body B and a flange F for mounting the carburetor on the intake manifold of the engine. Body B and flange F are of a lightweight material such as aluminum. A first pair of induction passages, generally indicated 1, is formed in the carburetor body, pair 1 including an inner induction passage I1 having a venturi V1 therewithin and an outer induction passage 01 which encircles the inner induction passage. Preferably, a second pair of induction passages, generally indicated C, is formed in the carburetor body. This second pair of passages includes an inner induction passage I2 having a venturi V2 therewithin and an outer induction passage 02 encircling the inner induction passage. As best shown in FIG. 1, passages I1 and O1 are concentric as are passages I2 and O2. When the carburetor is installed on an engine's intake manifold, pairs 1 and 2 of induction passages are aligned with the respective intake ports of the manifold.

A choke valve 3 is positioned at the inlet to each inner induction passage and the choke valves are commonly mounted on a rotatable choke shaft 5. The choke valves are movable between a closed and an open position as will be described hereinafter. The choke valves are shown in their fully open position in FIG. 1 and one of the choke valves is shown in a closed position in FIG. 4. A throttle valve 7 is positioned at the outlet of each pair of induction passages. The throttle valves are commonly mounted on a rotatable throttle shaft 9 and the throttle valves are movable between a closed and an open position; the fully open position of the throttle valves being indicated in FIG. 1.

Figure 4:
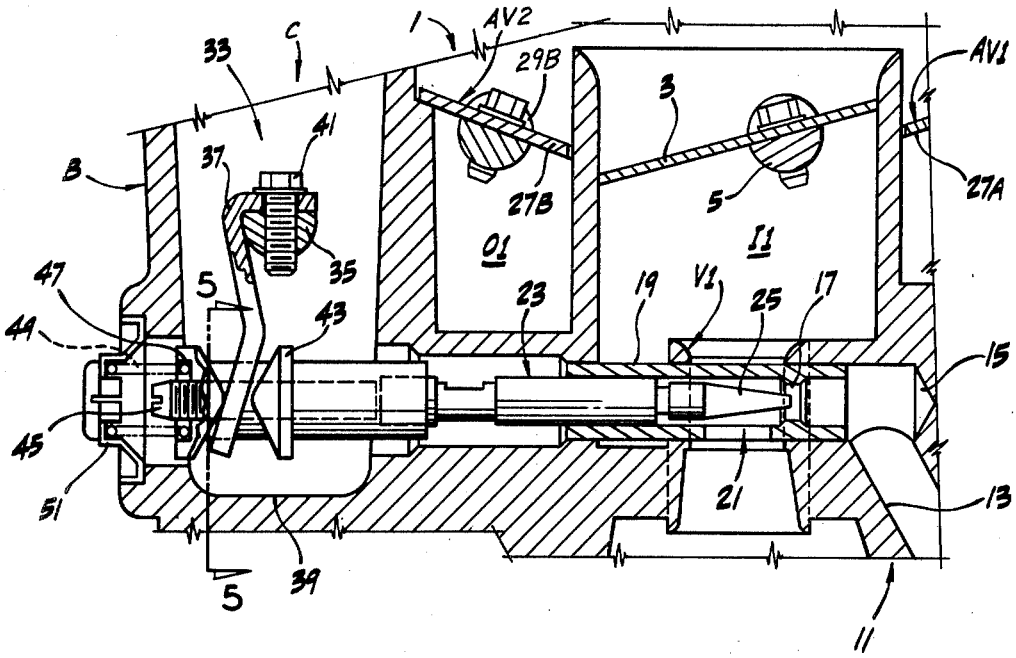
FIG. 4 is a sectional view of the carburetor taken along line 4—4 in FIG. 1.

Fuel is delivered from a fuel bowl (not shown) of the carburetor to the inner induction passage of each pair of induction passages through respective fuel circuits 11, one of which is shown in FIG. 4. Each fuel circuit includes an upwardly sloping fuel passage 13 and a horizontal fuel passage 15 which connects with passage 13 at the upper end of the passage. Each passage 15 has an outlet 17 at the venturi in the respective inner induction passages. Fuel is admitted into the lower end of each passage 13 through respective openings in the bottom of the fuel bowl. A pair of tapered metering rods (not shown) are vertically disposed in the fuel bowl with the tapered end of each metering rod projecting into one of the openings. This is as is well known in the art. As is further well known in the art, the metering rods are suspended from hangar assemblies (not shown) and are raised and lowered relative to the respective openings by the rotation of a shaft S (see FIGS. 1 and 2). A lever L is rigidly mounted on one end of shaft S and the lever is connected to a throttle lever TL via a connecting rod or link R. The operation of this arrangement is well known in the art and is such that as throttle shaft 9 rotates in the direction to open throttle valves 7, shaft S is rotated in the direction to withdraw the tapered ends of the metering rods in the fuel bowl from their respective openings so more fuel flows from the fuel bowl into the inlet of each passage 13. As throttle shaft 9 rotates in the throttle valve closing direction, shaft S is rotated to insert the tapered end of the metering rods into their respective openings so less fuel is admitted into each passage 13.

A support strut 19 (FIGS. 1 and 4) extends transversely of each pair of induction passages to support each venturi assembly. Each strut is hollow and is open as indicated at 21. A metering rod 23 extends transversely of each induction passage and is positioned within strut 19. Each metering rod is slidable within its respective strut and has a variable diameter end portion 25 projecting into the respective outlets of respective fuel circuits 11. Further, each metering rod is movable relative to its associated outlet 17 to vary the quantity of fuel delivered to each pair of induction passages. As shown in FIG. 4, metering rod 23 is movable in a horizontal plane relative to outlet 17.

Figure 6:
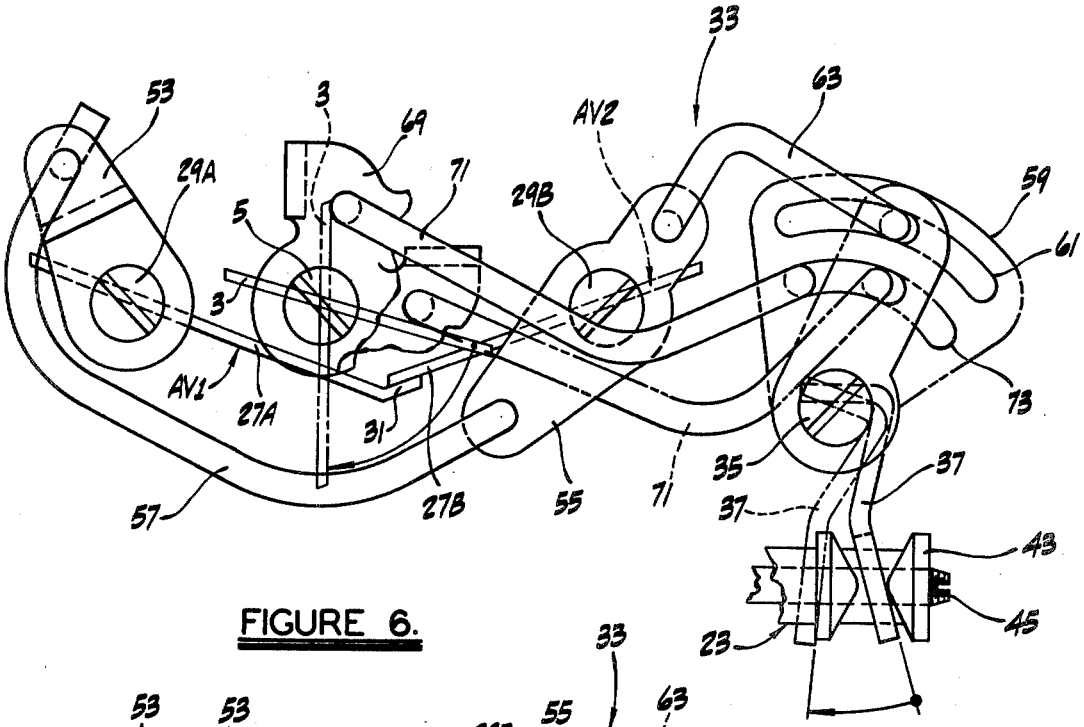
FIGS. 6 and 7 are side elevational views of linkage mechanism of a carburetor of FIG. 1 illustrating the working of the linkage during various stages of carburetor operation.

An air valve, generally indicated AV, as positioned in the outer induction passage of each pair of induction passages. The air valve is a split valve having a first section AV1 and a second section AV2 each respectively closing a portion of the outer induction passages. Specifically, each air valve section is a rectangular plate, 27A and 27B respectively, contoured to fit around a portion of the inner induction passage of each pair of induction passages. Each plate is mounted on a rotatable shaft, 29A and 29B respectively, and closes approximately one-half of the area of the outer induction passages. As shown in FIG. 6, plate 27A has an outwardly extending lip 31 at its lower end; this lip acting as a seat for plate 27B of the air valve. Air valve AV normally closes the outer induction passage of each pair of induction passages so air is initially drawn into the engine on which the carburetor is mounted only through each inner induction passage. However, an increasing flow of air into the carburetor, as occurs when the engine is accelerated or experiences an increasing load, exerts a force on the air valve, i.e., an increasing air pressure on the outer surface of plates 27A and 27B, which opens the air valve so air is drawn into the engine through both induction passages of each pair.

Figure 5:
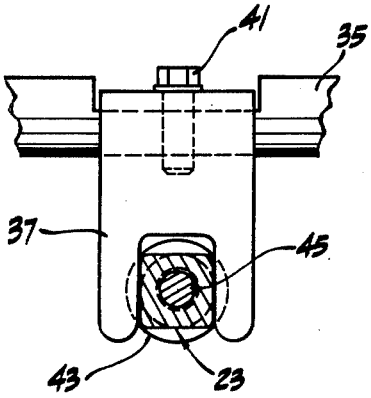
FIG. 5 is a sectional view of a metering rod assembly of the carburetor taken along line 5—5 in FIG. 4.

Air valve AV is linked to metering rods 23 via a linking means, generally indicated 33, to simultaneously move each metering rod relative to its associated fuel circuit outlet as the air valve opens or closes thereby to change the quantity of fuel delivered to each pair of induction passages. The linking means comprises a rotatable counter shaft 35 and a pair of levers 37 carried by the shaft. As shown in FIG. 4, a cavity 39 is formed in body B of the carburetor forward of the induction passages. The cavity extends down to a level somewhat below that of the metering rods. Counter shaft 35 extends transversely of this cavity in a perpendicular relationship to metering rods 23. Levers 37 are attached to shaft 35 by screws 41 and project downwardly from the shaft to contact the metering rods. The depending end of the levers is forked as shown in FIG. 5. Each metering rod has a cap 43 fitted over its back end and the cap has recesses in its sides. The forked end of the levers are received in these recesses so the levers straddle the metering rods. Each metering rod 23 is axially bored to receive an adjustment screw 45 to adjust the position of the metering rods relative to their associated outlets and the leanness or richness of the mixture produced. Cap 43 has an annular recess 47 in rearward face and a bias spring 49 seats against cap 43 and a plug 51 which is fitted into an in body B immediately behind the back end of each metering rod. Each spring 49 biases its associated metering rod in a forward direction to insert the tapered end of the metering rods into their respective fuel circuit outlets 17.

A fixed lever 53 is rigidly mounted on one end of shaft 29A and a second fixed lever 55 is rigidly mounted on the corresponding end of shaft 29B. Lever 53 is an elongate lever secured to shaft 29A at one end; while lever 55 is a center pivot lever. A connecting rod 57 interconnects levers 53 and 55 to form a solid connection between the two; one end of rod 57 being attached to the free end of lever 53 and the other end of the rod being attached to one end of lever 55. With this solid connection, movement of one of the air valve sections produces a simultaneous corresponding opening movement of the other air valve section. A third fixed lever 59 is rigidly mounted on the end of shaft 35 corresponding to the ends of shafts 29A and 29B on which levers 53 and 55 are mounted. Lever 59 has a lost motion slot 61 and a connecting rod 63 has one end captured in the lost motion slot. The other end of rod 63 is attached to the end of lever 55 opposite the end to which rod 57 is attached. A coil spring 65 is secured to the end of shaft 29B opposite lever 55 and biases the shaft in a direction to close air valve section 29B (a clockwise direction as viewed in FIGS. 2, 6 and 7). Further, a coil spring 67 is secured on shaft 35 inwardly of lever 59. This spring biases the shaft for rotation in the direction to insert the tapered ends of the metering rods into their respective fuel circuit outlets (also a clockwise direction as viewed in FIGS. 2, 6 and 7).

A choke lever 69 is attached to the end of shaft 5 corresponding to the ends of shafts 29A, 29B and 35 on which the aforesaid fixed levers are mounted. A connecting rod 71 interconnects the choke lever with the fixed lever 59 which has a second lost motion slot 73 in which one end of rod 71 is captured. A vacuum motor M1 has a movable stem 75 projecting therefrom and the stem has a lost motion slot 77 at its outward end. Lever 69 has a lost motion slot 79 and a connecting rod 81 has its ends respectively captured in slots 77 and 79. A lever 83 is rigidly mounted on the other end of choke shaft 5 and is connected to a temperature unit (not shown). The temperature unit operates, as is well known in the art, to exert a closing force on the choke valves, this force lessening as engine temperature increases. Coil springs 85 and 87 are positioned on respective ends of shaft 5, spring 85 being inward of lever 69 on the one end of the shaft and spring 87 being inward of lever 83 on the other end of the shaft. Both springs bias the choke shaft in the direction to open choke valves 3.

Figure 2:
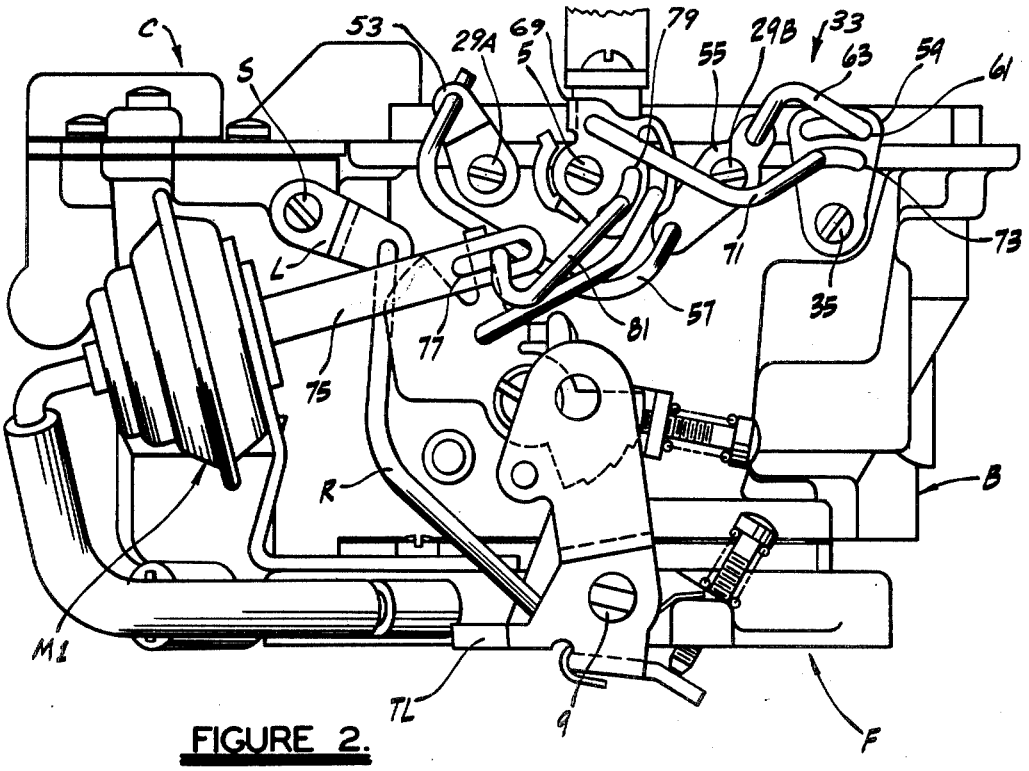
FIGS. 2 and 3 are side elevational views of the carburetor of FIG. 1.
Figure 3:
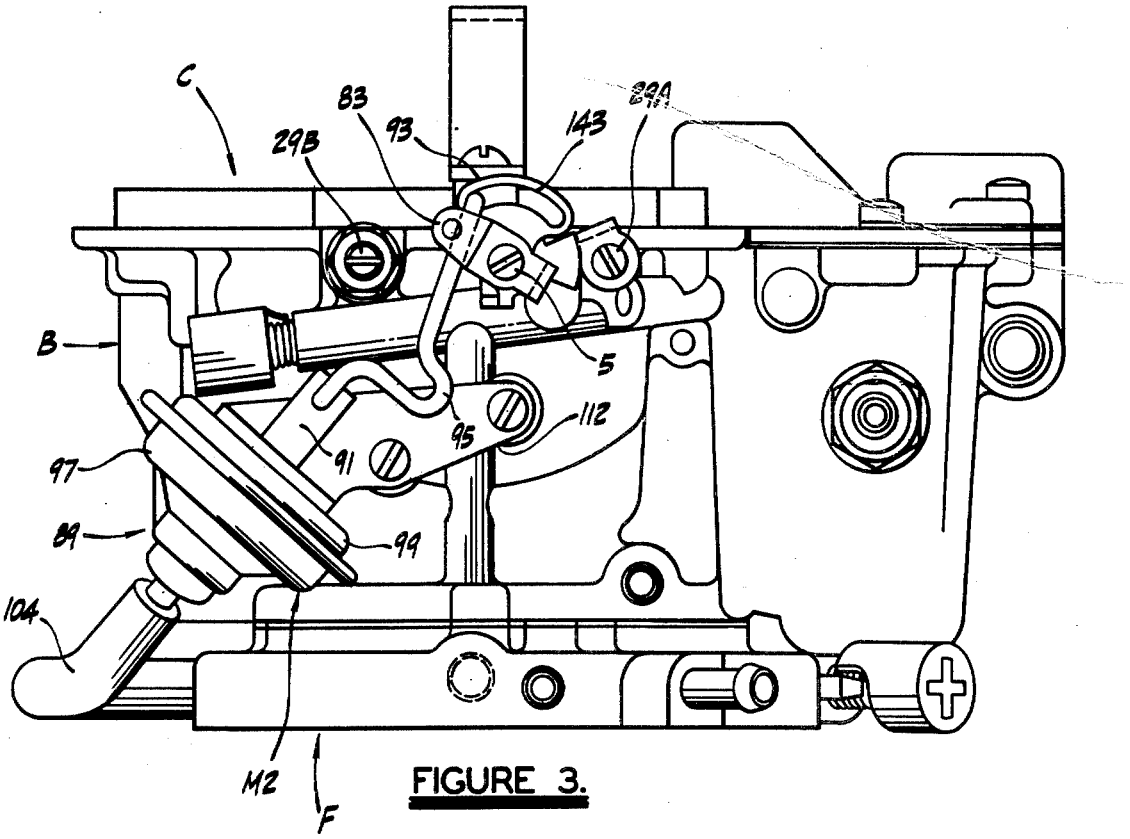

Referring to FIGS. 2, 3 and 6, when the engine on which carburetor C is installed is cold, both choke valves 3 are in the solid line position shown in FIG. 6, i.e., in a closed position closing the inlet of both inner induction passages I1 and I2. Lever 69 is at the position shown in FIG. 2 (which corresponds to the solid line position of the lever in FIG. 6). Connecting rod 71 exerts a counterclockwise rotative force on shaft 35 when the choke valves are closed and levers 37 are at their solid line position in FIG. 6, at which position their associated metering rods are moved to the right to withdraw the tapered ends of the rods from their associated fuel circuit outlets 17. With the tapered ends of the metering rods withdrawn from the fuel circuit outlets, a larger area is provided at each outlet for fuel to be drawn into the inner induction passages during cranking of the engine. This insures that the air-fuel mixture produced in carburetor C and combusted in the engine is sufficiently rich to start the engine. When the engine starts, vacuum motor M1 is exposed to manifold vacuum and stem 75 is pulled to the left as viewed in FIG. 2. This results in a clockwise rotative force being exerted on lever 69 and choke shaft 5 and the shaft rotates clockwise to move the choke valves to an initially open or choke break position. The opening force exerted on the choke shaft by vacuum motor M1 is opposed by the choke valve closing force exerted on the other end of the choke shaft by the temperature unit. As the engine warms up, the closing force produced by the temperature unit gradually lessens and the choke valves move to their fully open position (the broken line position shown in FIG. 6). As the choke shaft rotates in the choke valve opening direction, connecting rod 71 moves from its extreme left position in lost motion slot 73 of lever 59 to a more central position (the broken line position of the connecting rod in FIG. 6). As this occurs, shaft 35 is urged in a clockwise direction of rotation and levers 37 are moved to their broken line position in FIG. 6 and force their associated metering rods 23 to the left as indicated by the arrow. The tapered ends of the metering rods are inserted into their associated fuel circuit outlets 17 to decrease the amount of fuel drawn into the inner induction passage of each pair of passages. As a result, the air-fuel mixture supplied to the engine is leaned out to provide the proper mixture for efficient engine operation and to help reduce emissions produced by the engine.

As the engine on which carburetor C is installed is operated throughout its range, the amount of air drawn into the carburetor is controlled by the degree to which throttle valves 7 are open. As more air is drawn into the carburetor, the air pressure on the upper surface of plates 27A and 27B of the air valve sections increases until the air valve is forced open. This opening force is, for example, 3 pounds per square inch (psi) on one type of V-8 automotive engine. Under normal driving conditions, throttle valves 7 are open approximately 25°–30° when this occurs. It will be understood that the force required to open the air valve may differ for different sizes and types of engines on which carburetor C is installed.

Figure 7:
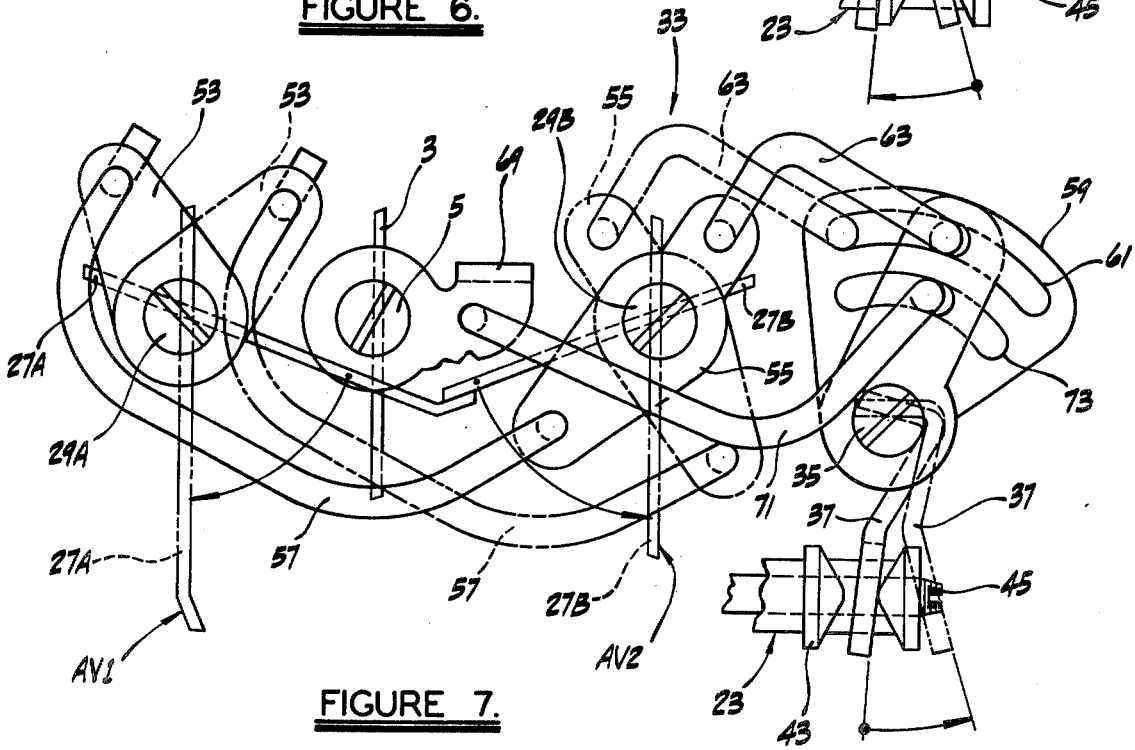

In any event, when the force exerted on air valve AV exceeds the minimum needed to open the valve, air valve section AV1 rotates in a clockwise direction as viewed in FIG. 7 and air valve section AV2 rotates in a counterclockwise direction as viewed in the figure. Because the shafts on which the air valve sections are mounted are interconnected, opening movement of one of the sections produces a simultaneous and corresponding opening movement of the other air valve section. As air valve section AV2 opens, lever 55 moves in a counterclockwise direction from its solid to its broken line position in FIG. 7. Connecting rod 63 moves from its centered position in slot 61 of lever 59 as this occurs and when it reaches the left end of the slot exerts a counterclockwise rotative force on counter shaft 35 to move metering rods 23 to the right as indicated by the arrow in FIG. 7. Thus, slot 61 comprises means for delaying the movement of the metering rods relative to their associated fuel circuit outlets until the air valve has partially opened. This movement of the metering rods withdraws their tapered ends from fuel circuit outlets 17.

Prior to the opening of air valve AV and the counterclockwise rotation of shaft 35, the position of metering rods 23 relative to their associated fuel circuit outlets is unchanged and the amount of fuel delivered to the inner induction passage of each pair of passages is controlled by the movement of shaft S in response to the movement of throttle lever TL as previously discussed. Now, however, as increased engine speeds are experienced, the withdrawal of the metering rods from the fuel circuit outlets permits more fuel to be admitted into each inner induction passage to mix with the air now flowing through both the inner and outer induction passage of each pair of induction passages. As air valve AV increasingly opens (as both air valve sections move from their solid to their broken lines positions in FIG. 7), the metering rods move further to the right as viewed in the figure and an increasingly smaller diameter portion of the tapered end of each rod is in its associated fuel circuit outlet. Thus, more fuel is supplied to each pair of induction passages to increasingly enrich the air-fuel mixture supplied to the engine. As engine speed decreases, less air is drawn into carburetor C and air valve AV begins to close. Air valve section AV1 moves counterclockwise from its broken line to its solid line position in FIG. 7 as the valve closes and section AV2 moves in a clockwise closing direction. Lever 55 moves clockwise with section AV2 as it closes as does lever 59. Shaft 35 is rotated clockwise and metering rods 23 are moved to the left (as viewed in FIG. 7) by levers 37. This movement inserts the tapered ends of the metering rods into their respective fuel circuit outlets and the amount of fuel delivered to each inner induction passage decreases. When the air valve is again closed, the metering rods have returned to their position relative to their associated fuel circuit outlets which existed prior to the air valve opening.

Referring to FIG. 1 and 3 a means, generally indicated 89 is also responsive to the vacuum created in the engine on which carburetor C is installed to exert a second opening force on choke valves 3. This second vacuum responsive means includes a vacuum motor M2 having a movable stem 91 connected to an extension 93 of lever 83 by a connecting rod 95.

Figure 8:
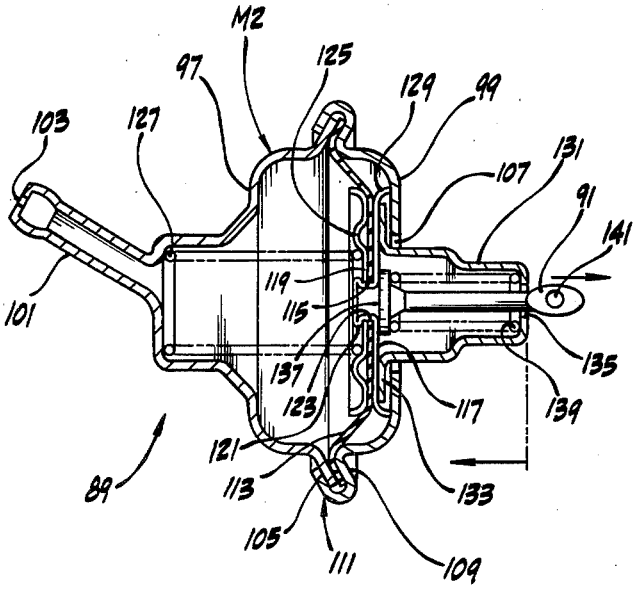
FIG. 8 is a sectional view of a vacuum motor taken along line 8—8 in FIG. 1. Corresponding reference characters indicate corresponding parts throughout the several views of the drawings.

As shown in FIG. 8, motor M2 is comprised of first and second housing section 97 and 99 respectively. Both sections are of one piece, thin wall sheet metal construction. Section 97 is cup-shaped and has a nipple 101 projecting outwardly from the bottom portion of the cup. A restricted opening 103 is formed in the end of the nipple. A hose 104 (FIG. 1 and 3) connects the nipple to the engine's intake manifold. Section 97 further has an outwardly extending annular rim 105. Section 99 is also cup-shaped and has a central opening 107 and an outwardly extending annular flange 109. Motor M2 is assembled by spinning or crimping flange 109 over rim 105 as indicated at 111. The vacuum motor is attached to body B of the carburetor by a bracket 112.

A flexible diaphragm 113 is annular shaped and is of rubber or a suitable synthetic resin material. The margin of diaphragm 103 is clamped between rim 105 and flange 109 to provide an air tight seal around the margin. The diaphragm has a central opening 115. The diaphragm is sandwiched between a pair of backing plates 117 and 119 respectively. Plate 117 has a projection 121 sized to fit through opening 115 in the diaphragm. Plate 119 has an opening 123 corresponding in size to opening 115 and projection 121 also fits through this latter opening. After plates 117 and 119 are assembled with diaphragm 113, the end of the projection is spun over the opening in plate 119 to capture the plate and diaphragm. Plate 119 further has an annular corrugation 125 to form a seat for one end of a spring 27. The other end of the spring seats against the bottom of the cup-shaped portion of housing section 97.

Plate 117 has an annular outwardly turned rim 129. A hollow cylindrical cup-shaped housing 131 fits through opening 107 in housing section 99 and has an outwardly extending annular flat flange 133 which seats against the outer surface of plate 117. After housing 131 is seated on plate 117, rim 129 is spun over the outer margin of flange 133 to capture the housing against the plate. The outer end of housing 131 has an opening 135 and stem 91 projects outwardly from the housing through this opening. Stem 91 is elongate in shape and terminates at its inner end in a head 137. The head is circular and of a larger diameter than opening 115 in diaphragm 113 and when in place, the head seats over the opening. A spring 139 is seated against head 137 and housing 131. The outer end of stem 91 is flattened and has an opening 141 in which one end of connecting rod 95 is captured. Lever 93 has a lost motion slot 143 in which the other end of the connecting rod is captured.

In operation, and as previously described, vacuum motor M1 causes rotation of choke shaft 5 when the engine on which carburetor C is installed is started to move the choke valves to a first open or choke break position. Further opening of the choke valves is dependent upon engine heating as sensed by the temperature unit and further rotation of the choke shaft occurs as the closing force exerted on shaft 5 via lever 83 lessens. The opening movement of the choke valves results in metering rods 23 being inserted into their associated fuel circuit 11 outlets 17 to lean out the air-fuel mixture produced in the carburetor. If however, the fuel mixture is leaned out too rapidly, the engine will misfire and die which adversely affects the emission produced by the engine.

Second vacuum responsive means 89 exerts a second opening force on the choke valves, but the exertion of this opening force is delayed until after the first opening force has been exerted on the choke valves. After the engine starts diaphragm 113 is exposed to engine vacuum via opening 103 in nipple 101. Because opening 103 is restricted, the diaphragm is not subjected to the full engine vacuum until some time after the engine has started. Thus, the restriction comprises means for delaying the exertion of the second opening force on the choke valves until after the first opening force has been exerted thereon. As the vacuum to which the diaphragm is subjected increases, the diaphragm moves to the left as viewed in FIG. 8 against the force of spring 137. As the diaphragm flexes, spring 139 urges stem 91 to the left, pulling the stem downwardly as shown in FIG. 3. The downward movement of stem 91 moves connecting rod 95 to the left end of slot 143 and exerts a counterclockwise force on shaft 5 to rotate the shaft and move the choke valves to a second and more fully open position. This second opening movement of the choke valve produces further clockwise rotation of lever 69 as viewed in FIG. 6, and this produces further clockwise rotation of shaft 35 in the manner previously discussed. Metering rods 23 are further inserted into fuel circuit outlets 17 and this further leans the air-fuel mixture supplied to the engine.

We claim:

1. In a carburetor for an internal combustion engine, said carburetor having at least one induction passage through which air is drawn into said engine, a fuel circuit through which fuel is delivered to said induction passage for mixing with air to form an air-fuel mixture combused in said engine, a choke valve positioned at the inlet of said induction passage and movable between a closed and an open position, means responsive to the temperature of said engine for exerting a closing force on said choke valve to close it, said closing force lessening as engine temperature increases, and means responsive to the vacuum created in said engine when it is running for exerting an opening force on said choke valve which overcomes said closing force and moves said choke valve to an open position, the improvement comprising;

A metering rod extending transversely of said induction passage and having a variable diameter end portion projecting into an outlet of said fuel circuit, said metering rod being movable relative to said fuel circuit outlet to control the quantity of fuel entering said induction passage;

linking means responsive to the movement of said choke valve for moving said metering rod relative to said fuel circuit outlet as said choke valve opens and closes, said variable diameter end portion of said metering rod being withdrawn from said fuel circuit outlet as said choke valve closes and inserted into said fuel circuit outlet as said choke valve opens; and second means responsive to the vacuum created in said engine for exerting a second opening force on said choke valve, said second vacuum responsive means including means for delaying the exertion of said second opening force on said choke valve until after the first said opening force is exerted thereon, the exertion of said second opening force on said a choke valve positioned at the inlet of said inner induction passage and movable between an open and a closed position, said choke valve opening to a first open position when said engine is started; and means responsive to the vacuum created in said engine for exerting a force on said choke valve to move said choke valve from its first to a second and more fully open position, said vacuum responsive means including means for delaying application of said force for a period after said engine is started and said linking means including means for exerting the force produced by said vacuum responsive means on said choke valve and for moving said metering rod relative to said outlet thereby to vary the quantity of fuel delivered to said inner induction passage and produce a resultant air-fuel mixture whose air-fuel ratio is sufficient both to keep said engine running and reduce emissions produced by said engine.

* * * * * choke valve moving said valve from its first said open position to a second and more fully open position and said variable diameter end portion of said metering rod being inserted further into said fuel circuit outlet by said linking means in response to the movement of said choke valve from its first to its second open position whereby the quantity of fuel delivered to said induction passage is varied by an amount necessary to produce a resultant air-fuel mixture whose air-fuel ratio is both sufficient to keep said engine running and reduce the emissions produced by said engine.

2. The improvement as set forth in claim 1 wherein said second vacuum responsive means comprises a vacuum motor.

3. The improvement as set forth in claim 2 wherein said choke valve is mounted on a rotatable shaft and said linking means comprises a fixed lever attached to one end of said choke shaft and a connecting rod connecting said fixed lever to said vacuum motor.

4. The improvement as set forth in claim 3 wherein said linking means further comprises a counter-shaft and a lever carried by said counter-shaft, said lever contacting said metering rod to exert a force thereon to withdraw the variable diameter end portion of said metering rod from said fuel circuit outlet when said counter-shaft is rotated in one direction and to insert the variable diameter end portion of said metering rod into said fuel circuit outlet when said shaft is rotated in the opposite direction.

5. The improvement as set forth in claim 4 wherein said metering rod is movable in a substantially horizontal plane relative to said fuel circuit outlet and said linking means comprises means for moving said metering rod back and forth in said plane.

6. The improvement as set forth in claim 4 wherein said linking means further comprises a second fixed lever attached to the other end of said choke shaft, a third fixed lever attached to the corresponding end of said counter-shaft, and a second connecting rod connecting said second and third fixed levers whereby rotation of said choke shaft when said second opening force is exerted on said choke valve produces rotation of said counter-shaft in the direction to insert the variable diameter end portion of said metering rod into said fuel circuit outlet.

7. The improvement as set forth in claim 3 wherein said vacuum motor comprises a housing and a flexible diaphragm extending across said housing, said housing having a restricted opening by which said diaphragm is exposed to the vacuum created in said engine a period of time after said engine is started thereby to flex said diaphragm after said period.

8. The improvement as set forth in claim 7 wherein said housing has a second opening therein on the opposite side of said diaphragm from said first opening and said vacuum motor further comprises a movable stem projecting through said second opening and connected to the first said fixed lever by the first said connecting rod, first spring means urging said stem against said diaphragm to seat thereon and second spring means biasing said diaphragm against movement when exposed to engine vacuum, the force exerted on said diaphragm by said second spring means being overcome by the force exerted on said diaphragm by said vacuum whereby said diaphragm flexes, said stem moving as said diaphragm flexes to exert said second opening force on said choke valve.

9. The improvement as set forth in claim 1 wherein said carburetor has a second induction passage, a second fuel circuit through which fuel is delivered to said second induction passage and a second choke valve positioned at the inlet of said second induction passage, said improvement further comprising a second metering rod extending transversely of said second induction passage and having a variable diameter end portion projection into an outlet of said second fuel circuit, said second metering rod being movable relative to said second fuel circuit outlet to control the quantity of fuel entering said second induction passage.

10. The improvement as set forth in claim 9 wherein said choke valves are attached to a common rotatable shaft for simultaneous opening and closing movement.

11. The improvement as set forth in claim 10 wherein said linking means is responsive to the movement of said second choke valve for moving said second metering rod relative to said outlet of said second fuel circuit.

12. The improvement as set forth in claim 11 wherein said linking means comprises a rotatable counter-shaft and first and second lever carried by said counter-shaft, said lever respectively contacting said metering rods to exert a force thereon to simultaneously withdraw the variable diameter end portion of said metering rods from the respective fuel circuit outlets when said counter-shaft is rotated in one direction and to simultaneously insert the variable diameter end portion of said metering rods into the respective fuel circuit outlets when said counter-shaft is rotated in the other direction.

13. A staged carburetor for an internal combustion engine comprising;

a carburetor body in which at least one pair of induction passages is formed for air to be drawn into said engine, said pair of induction passages including an inner induction passage having a venturi therewithin and an outer induction passage encircling said inner induction passage;

a throttle valve positioned at the outlet of said pair of induction passages and movable between a closed and an open position to control the flow of air through said induction passages;

at least one fuel circuit through which fuel is delivered from a source thereof to said inner induction passage, said fuel circuit having an outlet at said venturi;

a fuel metering rod extending transversely of said induction passages and having a diameter variable along its length, one end of said metering rod being movable relative to said outlet to vary the quantity of fuel delivered;

an air valve positioned in said outer induction passage and normally closing said passage whereby air is initially drawn into said engine only through said inner induction passage, an increased demand for air by said engine resulting in an opening force being exerted on said air valve to open it so air is drawn into said engine through both induction passages;

means linking said air valve to said metering rod to move said metering rod relative to said fuel circuit outlet as said air valve opens thereby to change the quantity of fuel drawn into said inner induction passage, the quantity of fuel delivered to said inner induction passage at any one time mixing with the air flowing through said pair of induction passages at that time to produce an air-fuel mixture combusted in said engine;